United States Patent [19]

Garfinkel

[11] Patent Number: 4,959,037

[45] Date of Patent: Sep. 25, 1990

[54] WRITING DOLL

[76] Inventor: Henry Garfinkel, 31 Dogwood Rd., Searingtown, N.Y. 11507

[21] Appl. No.: 308,020

[22] Filed: Feb. 9, 1989

[51] Int. Cl.[5] ..... A63H 3/28; A63H 33/24; A63H 3/33; B43L 13/00

[52] U.S. Cl. ..... 446/299; 446/302; 446/146; 446/484; 901/15; 33/18.2; 33/23.01; 369/63; 369/64; 369/70

[58] Field of Search ..... 446/299, 302, 298, 297, 446/296, 146, 354, 353, 33/, 484, 485; 901/15, 23, 24, 50; 33/18.2, 26, 23.01; 369/47, 50, 63, 64, , 70, 31; 434/236, 267, 308

[56] References Cited

U.S. PATENT DOCUMENTS

| | | | |
|---|---|---|---|
| 512,089 | 6/1894 | Bangerter | 33/18.2 |
| 3,119,184 | 1/1964 | Projansky | 33/25.5 |
| 3,209,996 | 10/1965 | Carson et al. | 33/23.01 X |
| 3,269,971 | 12/1971 | Antel et al. | 446/146 X |
| 3,654,704 | 4/1972 | Poglein | 33/18.2 |
| 3,912,694 | 10/1975 | Chiappe et al. | 446/354 X |
| 4,178,698 | 12/1979 | Cornell | 434/308 |
| 4,398,720 | 8/1983 | Jones et al. | 901/15 X |
| 4,585,387 | 4/1986 | Jayne | 901/15 X |
| 4,808,142 | 2/1989 | Berliner | 446/353 X |
| 4,843,497 | 6/1989 | Leyden | 369/63 X |

*Primary Examiner*—Robert A. Hafer
*Assistant Examiner*—D. Neal Muir
*Attorney, Agent, or Firm*—Dennison, Meserole, Pollack & Scheiner

[57] ABSTRACT

A writing doll having a body portion, a head mounted on top of the body portion, a pair of legs protruding from the bottom of the body portion, and a pair of arms connected to the body portion. The arms include a pair of hands with one hand formed to hold a stylus. The writing doll includes a forearm motion control system mounted in at least one of the arms near the stylus hand for moving the stylus hand along an axis in a X direction. A shoulder motion control system mounted in at least one of the arms near the body portion for moving the stylus hand along an axis in a Z direction, and an elbow motion control system mounted in at least one of the arms between the forearm and shoulder motion control systems for moving the stylus along an axis in a Y direction. The doll also has a control means connected to each motion control system for providing control signals to control the movement of the motion control systems in each of the axis directions. The writing doll can teach simple arithmetic as well as tell stories and draw pictures.

16 Claims, 4 Drawing Sheets

FIG. 2
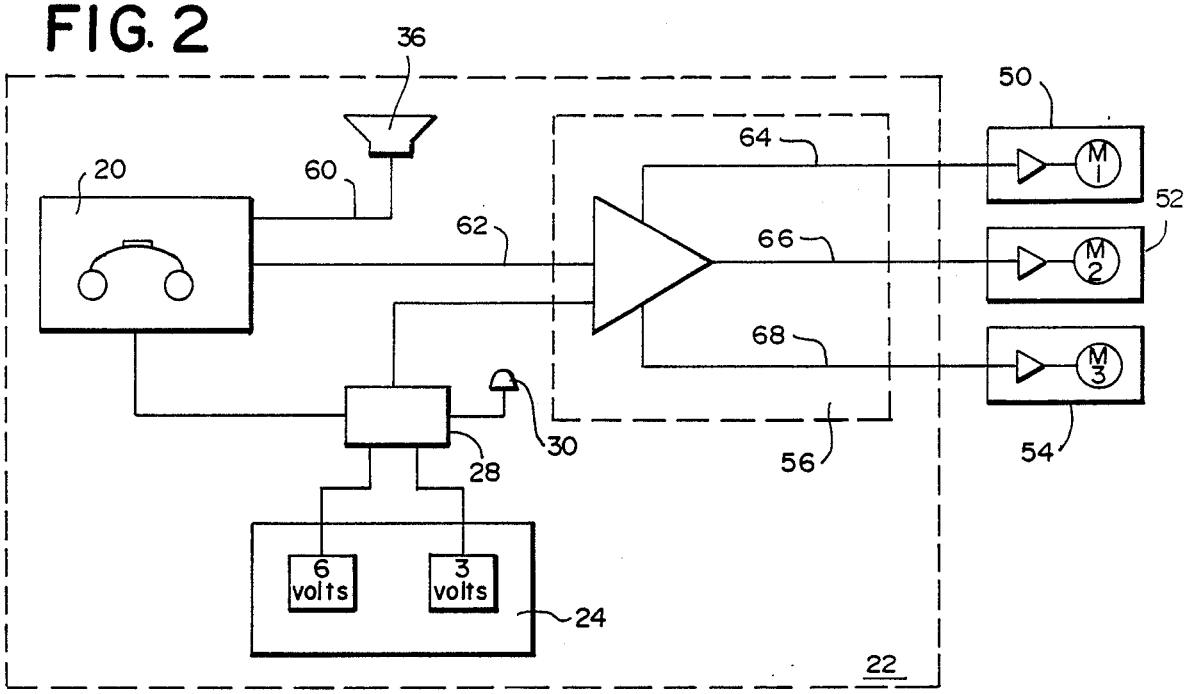
FIG. 3
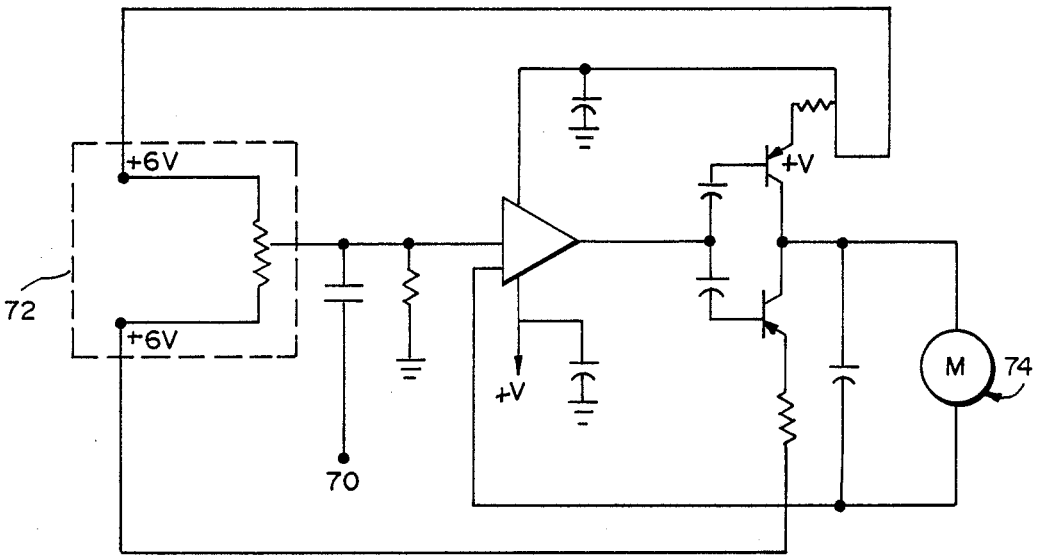
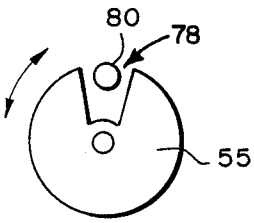
FIG. 5
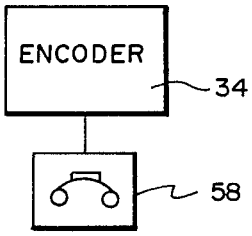
FIG. 4

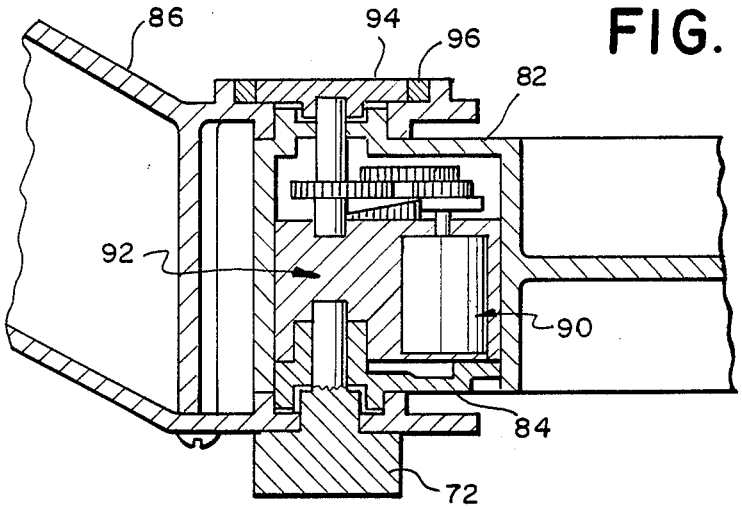
FIG. 8
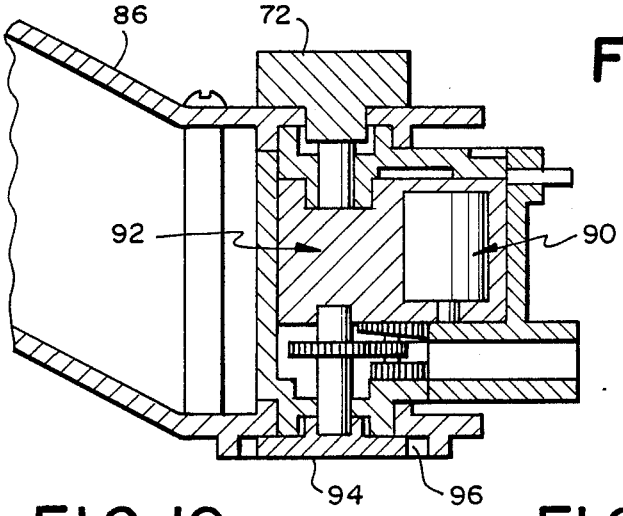
FIG. 9
FIG. 10
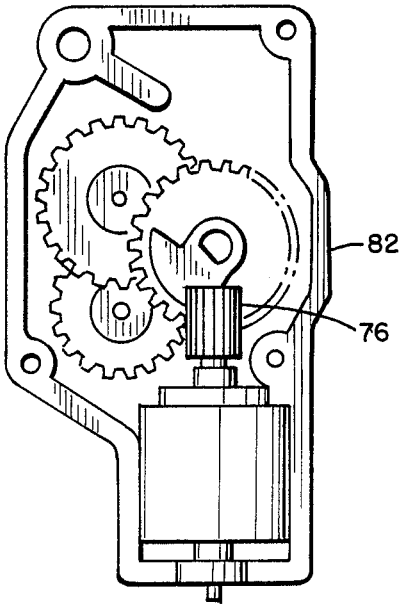
FIG. 11
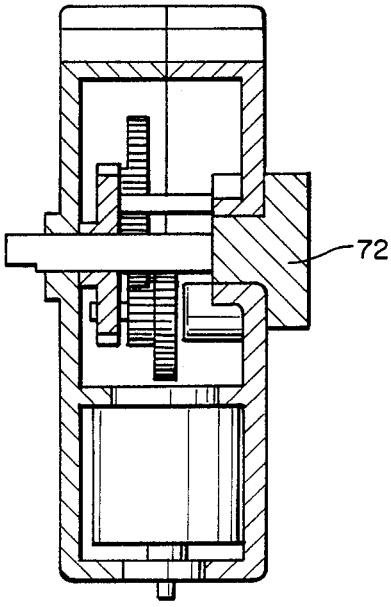

WRITING DOLL

BACKGROUND OF THE INVENTION

Field of the Invention

The present invention relates to a doll having an arm controlled by magnetic tape information for writing and includes a desk/chair combination as a writing surface.

The prior art discloses numerous examples of dolls which dance, talk or write.

U.S. Pat. No. 3,912,694 to Chiappe et al discloses mechanical doll which performs various coordinate movements, such as dancing, talking and other movements. The doll is controlled by signals stored on a magnetic tape having at least two tracks wherein the first track is a musical score, or other audio signals, and the second track is recorded with various pulse trains having different frequencies.

U.S. Pat. No. 4,654,659 to Kubo discloses a remote control toy wherein signals are stored on a cassette tape which may be input to a central processing unit mimicking each and every output programmed into the toy.

U.S. Pat. No. 4,516,950 to Berman et al discloses a doll adapted to be remotely controlled as a walking doll.

U.S. Pat. No. 4,660,033 Brandt discloses an animation costume with a recorder for pre-programming operations that include, for example, control of mouth movements by a radio signal which may be synchronized with a prerecorded audio track.

U.S. Pat. Nos. 3,080,679 to Hardigan and 3,162,980 to Hellman disclose dolls with tape recorders. U.S. Pat. Nos. 972,920 to Riggs, 2,895,258 and 3,142,131 to Von Rabenau and 4,127,963 to Shiraishi represent prior art writing machines or drawing dolls wherein mechanical means, e.g. cam and cam followers or gear trains, are provided for enabling a doll to write or draw.

U.S. Pat. No. 4,334,221 to Rosenhagen et al discloses a multi-vehicle multi-controller with a toy operating means wherein a decoder is utilized to operate servos for propelling and steering a toy vehicle.

Each of these prior art patents disclose some type of control system or apparatus to facilitate a dancing, talking, walking, or writing doll. However, none of the prior art patents provide a writing doll with simple electronics for writing during interaction with a child.

SUMMARY OF THE INVENTION

The doll of the present invention has the capability to write with an electronically controlled arm. The arm is controlled by magnetic tape information and is operated in association with a desk/chair combination which provides a writing surface. The arm operates by means of a plurality of servos. A first servo system positioned in the forearm provides movement in the X axis and a second servo system positioned in the elbow provides movement in the Y axis direction for the arm. A third servo system is positioned at the shoulder of the doll to lift and lower the arm in the Z axis of direction.

A stereo tape player is provided with a tape cassette. The tape cassette is encoded with audio information on one track and pulse information on the other track. The pulse information provides code pulses to drive the three servo systems. These pulses are decoded initially into three channels using a decoder chip and sent to the respective servo systems.

The doll preferably sits in a desk/chair using an interlocking slide mechanism for locking the doll into position and orientating the doll's writing arm. A precise writing surface for the doll is provided by the desk/chair. The electronics may be mounted either under the desk/chair or in the body of the doll.

BRIEF DESCRIPTION OF THE DRAWINGS

FIG. 2 is a block diagram of the system;

FIG. 3 is a schematic diagram of a servo amplifier;

FIG. 4 is a block diagram of an encoder system;

FIG. 5 is a diagram of a wedge servo positioned in the shoulder of the writing doll;

FIGS. 8 and 9 are sectional views of the servo systems; and

FIGS. 10 and 11 are sectional views of another embodiment for the shoulder servo system.

DESCRIPTION OF THE PREFERRED EMBODIMENTS

Figure 1:
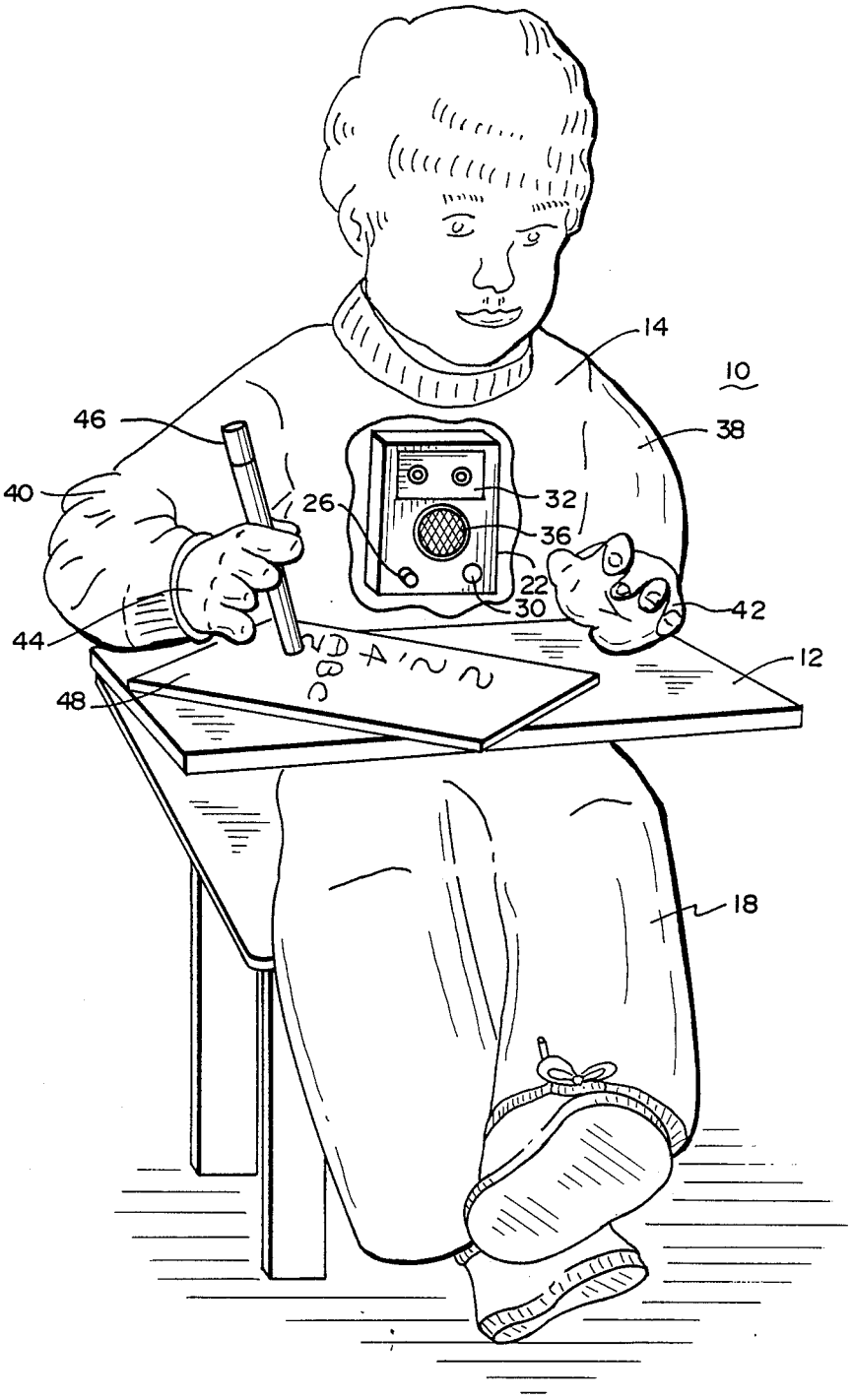
FIG. 1 is a perspective view showing the doll of the present invention sitting on the desk/chair in a writing position bolding a stylus.
Figure 6:
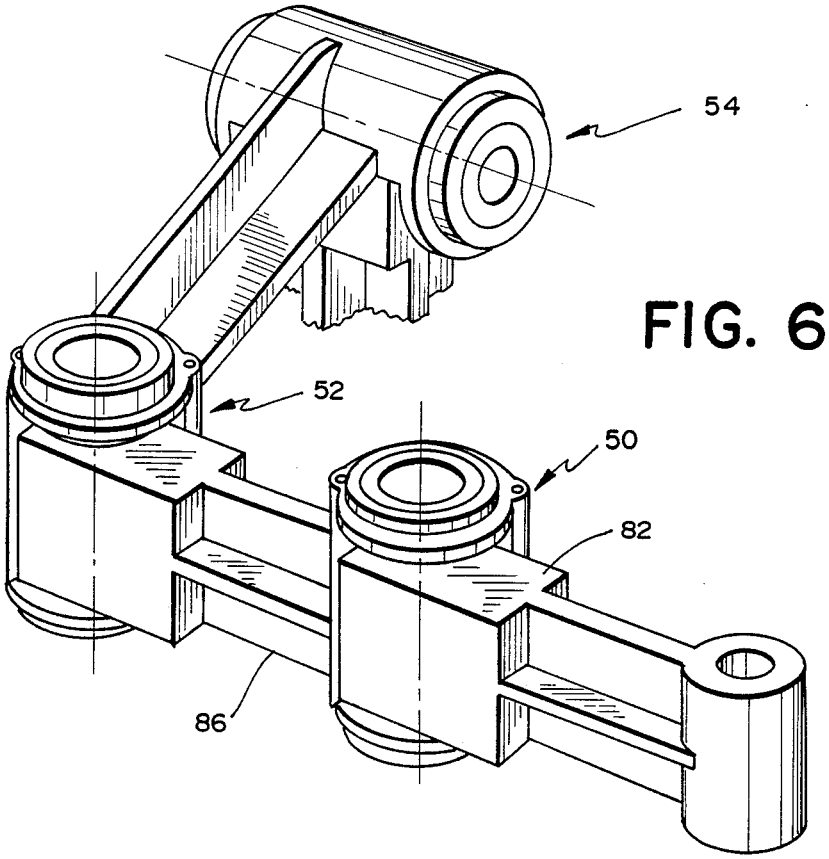
FIG. 6 is a perspective view of the writing arm.
Figure 7:
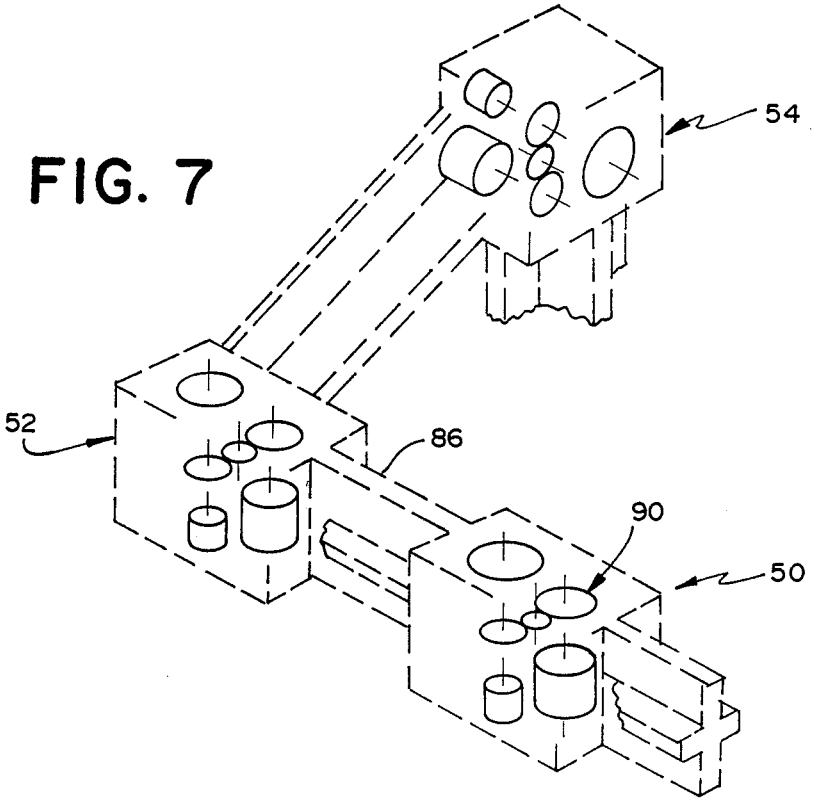
FIG. 7 is a view of the servo systems in the writing arm.

Reference is now made to FIGS. 1 and 2 which illustrate the doll 10 sitting in the desk/chair 12 and the electronics. This position is considered to be the writing position. Obviously, the writing doll 10 can be removed from the desk/chair 12 allowing a child to cuddle or play other suitable children's games with the doll 10.

The writing doll 10 is constructed and operated in accordance with a preferred embodiment of the present invention. The doll comprises a body portion 14, a head portion 16 and a suitable body covering 18. The body portion 14 is typically formed of molded plastic and in the preferred embodiment is hollow, receives audio cassette player 20 and control system 22 hereinafter to be described. It will be understood that a suitable mounting means may be fixedly mounted within the body cavity 14 of the doll 10 so that the control system 22 which can hold the cassette player 20. Alternatively, the control system 22 can be mounted and secured under the desk/chair 12 combination.

The control system 22 located in the body portion 14 of the doll 10 includes the audio cassette player 20 which is a multi-track tape recorder and is of a type commonly available. The player 20 is capable of playing a number of tracks simultaneously. The control system 22 includes a suitable power supply 24, such as batteries, to supply the tape player 20 with three volts and the rest of the system with six volts.

Also, mounted on the control box is an on/off switch 26. Whenever the child tires of listening to the recorded message the child can shut off the tape player 20 by pushing the knob 26 to the off position. In this position, all the power is turned off. The on/off switch 26 is also controlled by the encoded data, such that, as an example, the doll 10 may draw a picture. Now, the control data will shut off the system to allow the child to color the picture. When the child wishes to continue, the child merely pushes the knob 26 to the on position.

The control system 22 contains circuitry 28 which compares the battery voltage to a known voltage reference. When the battery voltage falls below the voltage set by the voltage reference, the light emitting diode (LED) 30 turns on. This indicating means 30 allows the battery to be changed before it is completely dead. The LED 30 is used to indicate low battery voltage.

The control system 22 further includes a door 32 which opens to facilitate placing and removing of respective cassette tapes. This access door 32 permits the child and/or adult to change the encoded information by simply removing the cassette tape from the doll 10 and replacing the old tape with a new tape which would have other encoded information stored thereon.

Each one of the cassettes has been encoded by use of an encoder 34, such as, for example, by standard encoding techniques and the encoder will be further explained with reference to FIG. 4. Since the encoding technique is rather simple, it is contemplated that the tape will be encoded by the parent or teacher such that a number of different languages, mathematical expressions, or even brialle can be taught to the child through the interaction with the writing doll 10. Of course, when the doll 10 is writing in braille a suitable embossing paper is necessary for the indicia.

Connected to the tape player 20 is a speaker 36 which is mounted in the control system 22 to provide voice and audio sounds for the doll 10.

The doll 10 includes two arms 38, 40 with appropriate hands 42, 44. The servo systems are positioned throughout the right arm 40 with the right hand 44 formed to hold a writing stylus 46. The left arm 38 and hand 42 are similarly fashioned and shaped to hold a piece of paper or pad of paper 48. Of course, the systems can be reversed to produce a left-handed doll, if so desired.

The stylus 46 may be, for example, a pencil, a crayon, a ballpoint pen, or the like and the pad 48 may simply be a pad of paper or a single sheet, such as shown in FIG. 1.

As shown in FIG. 2, the right arm of the doll is operated by means of a plurality of servo systems 50, 52, 54. The servo systems are off the shelf components. A first servo system 50 is located in the right forearm of the doll. The first servo system 50 allows the hand 44 to move in the X axis of direction or, alternatively, with reference to the paper 48, controls movement of the stylus 46 across the page from left to right or right to left.

A second servo system 52 is located in the elbow of the right arm 40 and operates in the Y axis of direction. This servo system 52 allows the stylus 46 to move from the top to the bottom of the paper 48 or from the bottom to the top of the paper 48.

A third servo system 54 which is located in the shoulder allows the arm 40 to move in the Z axis of direction such that the stylus 46 can be lifted and lowered with reference to the paper 48. Although, this shoulder servo system 54 can be identical to the other two servo systems 50, 52, a wedge servo system can also be used and this wedge servo system 55 will be further explained with reference to FIG. 5.

Referring to FIGS. 2, 3 and 4, shown are the basic diagrams of the electronics for the writing doll 10.

With reference to FIG. 2 which is a schematic diagram of the system 22, the system 22 is powered by the power supply 24 which supplies three volts to the stereo audio tape player 20 and six volts to a decoding unit 56.

Initially, a blank multi-track tape 58 is placed in the encoder system 34 and the tape 58 is encoded with the data which represents the X, Y and Z axis of direction for the arm 40 to be moved. A suitable sound track is also taped on a corresponding track. The encoder chip 34 is a standard four channel chip manufactured by Oki Electric and is Model No. L9362OKI Japan 7604.

To operate the system, the encoded cassette 58 is loaded into the tape player 20 through the cassette door 32 located in the control system 22. The multi-track tape 58 which contains audio and corresponding digital data begins to play. The audio portion is fed by way of an audio line 60 to the speaker 36 and the corresponding digital data is sent by way of a data line 62 to the decoder chip 56.

The decoder chip 56 is a standard 16 dual inline chip with a four channel output. The decoder chip 56 is manufactured by Oki Electric and is model No. L963OKI Japan 6901. The pulses are fed to the decoder chip 56 which then breaks down the pulses into three indivdual pulse messages which in turn are fed to the respective servo systems.

In the preferred embodiment, the decoding chip is connected to the servo systems 50, 52, 54 as follows. Channel 1 is blank and is not used. Channel 2 is connected by way of line 66 to the elbow servo system 52, channel 3 is connected by way of line 68 to the shoulder servo system 54 and channel 4 is connected by way of line 64 to the forearm servo system 50. The channels 2, 3 and 4 are set at reverse polarity. The reverse polarity provides drag and pressure for simulating the writing movement.

Referring now specifically to FIG. 3 which is a schematic diagram of a servo system. The line 64, 66 or 68 is connected to the channel at input 70 and carries the pulsed message to the respective servo system 50, 52 or 54. Upon receipt of the pulsed message a potentiometer 72 in each servo system is set to the respective position of movement corresponding to the range of motion. For example, a minus six volts would indicate the left-hand edge of the paper and a plus six volts would indicate the left-hand edge of the paper in the X axis of direction. For the Y axis of direction, a minus six volts would indicate the bottom of the paper and a plus six volts would indicate the top of the paper. For the Z axis of direction of minus six volts would indicate that the arm is touching the paper and a plus six volts would indicate that the arm is lifted off the paper. The angular placement of the axis simulates a position of a child's arm when the child writes or draws. The motors, generally indicated as 74, are standard three phase DC motors with gear reduction units for increased torque output.

Referring to FIG. 5 which illustrates another embodiment for the mechanics the shoulder servo system 54. It will be understood that the three servo systems 50, 52 and 54 are similar in the preferred embodiment except, it has been contemplated that the shoulder servo system 54 can have a wedge cut-out 25 which is described with reference to FIG. 5. Also, it will be understood that a gear 76, in a gear assembly 82 can be used instead of a servo which is illustrated with respect to FIG. 10. Both devices function identical and the difference would be that the worm gear would be mounted external to the shoulder.

The shoulder servo system 54 may contain a unique servo to force the arm 40 down to the writing position. Pressure is applied to the arm 40 of the doll 10 without using added weight and the wedge servo 55 eliminates most of the jittery movement which may be caused by noise or other disturbances. The small angle wedge indicated generally at 78 is made in the servo wheel 55. This in effect always leaves the arm assembly free. However, it is effective enough to lift the arm 40 adequately and in the opposite direction apply a few grams of force so that it dampens the initial movement. The servo wheel 55 in the writing position should push against a left pin 80 and provide a downward force.

The writing arm 40 will now be explained with reference to FIGS. 6–11 which illustrate the mechanical aspects of the arm 40.

The forearm servo system 50 is mounted in a main member 82 and secondary member 84, both of which have a configuration which provides a substantial bearing surface which mates with a third member 86. Numeral 90 indicates generally the components required from existing servos which are commonly well known off the shelf components. Numeral 92 signifies the midsection of an existing servo on which the gears and motor are mounted. Numeral 94 is a disk which when combined with an outer '0' ring 96 provides the desired clutching action due to friction. The potentiometer 72 is used to determine angular displacement along the respective axis.

Accordingly, the lifting of the arm 40 functions to lift the stylus 46 from the pad 48 during those intervals in the operation when it is desired that no mark be scribed upon the pad. For example, if the expression being written consists of separate letters or more than one word, the lifter arm 40 lifts the stylus 46 from the pad 48 form the space between the letters of the words. Similarly, the stylus 46 is lifted from the pad 48 during such operations as the dotting of an "i" or the crossing of a "t" or to provide spaces between the elements of a mathematical expression such as "2+2=4", or the like.

Obviously, from the previously description it is evident that the educational aspects of the doll 10 which involve drawing, writing or other movements with the stylus 46 are only limited to the encoded information. The electronics and mechanics are set to mimic the pulsed information.

Accordingly, it will be understood that the above description of the present invention is susceptible to various modification, changes and adaptions, and the same are intended to be comprehended within the meaning and range of equivalents of the appending claims.

What is claimed is:

1. A writing doll having portions defining a head and appendages comprising:

at least one apppendage having a portion adapted to hold a writing stylus;

a first motion control means mounted in said at least one appendage near said stylus holding portion for moving said stylus holding portion along a generally planar writing surface in an arcuate direction;

a second motion control means for oscillating said stylus holding portion about a horizontal axis for at least lifting said stylus holding portion out of writing engagement with said generally planar writing surface;

a third motion control means mounted in said at least one appendage between said first and said second motion control means for moving said first motion control means and said stylus holding portion along said generally planar writing surface in a second arcuate direction; and means responsive to electronically stored data for providing control signals for operation of each said motion control means.

2. The writing doll of claim 1, wherein the means responsive to electronically stored data is integrated into the doll.

3. The writing doll of claim 1, wherein the means responsive to electronically stored data is integrated into an adjacent support structure.

4. The writing doll of claim 1, wherein said means responsive to electronically stored data includes a decoding means for receiving electronically stored data and providing decoded signals to said respective control means.

5. The writing doll of claim 1, wherein said means responsive to electronically stored data is responsive to magnetically stored digital data.

6. The writing doll of claim 5, wherein the means responsive to electronically stored data comprises a multi-track tape player for playing a cassette tape having at least an audio information track and a digital information track whereby the digital information comprises the stored data for providing control signals for operation of said motion control means.

7. The writing doll of claim 1, wherein said motion control means are servo mechanisms.

8. A writing doll having portions defining a head and appendages comprising:

a first servo control means mounted in said at least one appendage near said stylus holding portion for moving said stylus holding portion along a generally planar writing surface in an arcuate direction;

a second servo control means for oscillating said stylus holding portion about a horizontal axis for at least lifting said stylus holding portion out of writing engagement with said generally planar writing surface;

a third servo control means mounted in said at least one appendage between said first and said second servo control means for moving one of said first and second servo control means and said stylus holding portion along said generally planar writing surface in a second arcuate direction;

control means connected to each said servo control means for providing decoded control signal to each said servo control means wherein said control signals control the movement of each of said servo control means in each of said directions and said oscillation; and decoder means connected to said control means for decoding electronically stored data control signals and directing the decoded signals to the respective servo control means.

9. The writing doll of claim 8, wherein each said servo control means includes:

a potentiometer for adjusting the control signal relative to the movement in the particular direction or oscillation;

an amplifier connected to said potentiometer for amplifying the decoded control signal; and a d.c. motor connected to said amplifier for receiving the amplified signal and moving the said at least one appendage based on the received amplified signal.

10. The writing doll of claim 9, wherein said d.c. motor is connected to a gear for providing movement.

11. A writing doll having portions defining a head and appendages comprising:

at least one arm having a hand portion adapted to hold a writing stylus;

a first motion control means mounted in said at least one appendage near said stylus holding portion for moving said stylus holding portion along a generally planar writing surface in a generally X direction;

a second motion control means for oscillating said stylus holding portion about a horizontal axis for at least lifting said stylus holding portion out of writing engagement with said generally planar writing surface;

a third motion control means mounted in said at least one appendage between said first and said second motion control means for moving said stylus holding portion along said generally planar writing surface in a generally Y direction; and control means connected to each said motion control means for providing control signals to each said motion control means wherein said control signals control the movement of said motion control means in each of said directions and said oscillation.

12. The writing doll of claim 11, wherein said control means includes a decoding means for receiving said control signals and providing decoded signals to said respective motion control means.

13. The writing doll of claim 12, comprising:

multi-track tape player for playing a cassette tape having control information encoded on it wherein said control information includes audio information and digital information such that said digital information is sent to said decoding means as control information;

speaker means for receiving said audio information for voicing said audio information; and power supply means for supplying power to said tape player and said decoding means.

14. The writing doll of claim 12, wherein said motion control means are servo mechanisms.

15. The writing doll of claim 11, wherein said second motion control means includes a servo wheel having a small wedge cut-out for eliminating jittery movement caused by control signal noise.

16. The writing doll of claim 11, wherein at least one of said motion control means comprises a gear.

* * * * *